US005953798A

United States Patent [19]

Matoba et al.

[11] Patent Number: 5,953,798

[45] Date of Patent: Sep. 21, 1999

[54] BUCKLE

[75] Inventors: Hiroshi Matoba, Toyama; Tomohisa Ishida, Kawaguchi, both of Japan

[73] Assignee: YKK Corporation, Tokyo, Japan

[21] Appl. No.: 09/135,792

[22] Filed: Aug. 18, 1998

[30] Foreign Application Priority Data

Aug. 19, 1997 [JP] Japan ..... 9-237747

[51] Int. Cl.[6] ..... A44B 11/00

[52] U.S. Cl. ..... 24/615; 24/633; 24/639

[58] Field of Search ..... 24/615, 633, 639, 24/642, 636, 637, 606, 640, 652

[56] References Cited

U.S. PATENT DOCUMENTS

| | | | |
|---|---|---|---|
| 4,633,549 | 1/1987 | Lovato | 24/615 |
| 4,888,858 | 12/1989 | Kasai . | |
| 4,998,328 | 3/1991 | Tanaka | 24/639 |
| 5,113,556 | 5/1992 | Murai et al. | 24/615 |
| 5,469,606 | 11/1995 | Hansen . | |
| 5,548,879 | 8/1996 | Wu | 24/633 |

FOREIGN PATENT DOCUMENTS

| | | |
|---|---|---|
| 0 204 250 | 12/1986 | European Pat. Off. . |
| 0 309 943 | 4/1989 | European Pat. Off. . |
| 0 346 861 | 12/1989 | European Pat. Off. . |
| 0 390 007 | 10/1990 | European Pat. Off. . |
| 0 623 296 | 11/1994 | European Pat. Off. . |
| 0 697 179 | 2/1996 | European Pat. Off. . |

*Primary Examiner*—Victor N. Sakran
*Attorney, Agent, or Firm*—Hill & Simpson

[57] ABSTRACT

A buckle comprises a male member and a female member adapted to couple with each other. The male member includes a fitting projection provided on a base thereof and the female member has a fitting cavity formed at its one end for fitting engagement with the fitting projection of the male member. A tongue-shaped presser plate and the actuating levers of the female member are substantially coplanar with the front wall and the corresponding side walls respectively, of the female member, when the male and the female member are coupled with each other.

6 Claims, 5 Drawing Sheets

BUCKLE

BACKGROUND OF THE INVENTION

1. Field of the Invention

The present invention relates to a buckle for joining a belt, a wrist watch band, etc.

2. Related Art

This type of buckle is disclosed in U.S. Pat. No. 4,888,858. The buckle comprises a pair of male and female members adapted to couple with each other. The male member includes a tongue-shaped presser plate and locking legs mounted on the lower side of the presser plate. The female member includes a case having a hollow chamber therein and locking members provided in the hollow chamber. The legs of the presser plate are engageable with the locking membered in the chamber so as to couple the male member with the female member. In order to couple the male member with the female member, first the tongue-shaped presser plate of the male member is placed in situ above the locking members of the female member. Then, the tongue-shaped presser plate is pressed against the female member until the locking means provided on the distal end of the legs come into locking engagement with the locking members of the female member so that the male member is coupled with the female member. In order to bring the male member out of coupling engagement with the female member, the actuating levers provided on the opposed sides of the female member are pressed toward each other against their own resiliency, thereby bringing the locking members provided on the lever out of locking engagement with the locking means of the male member, so that the male member is sprung up out of coupling engagement with the female member.

The above conventional buckle has a drawback. The distal end of the tongue-shaped presser plate of the male member projects beyond the corresponding edge of the female member, thus being liable to be caught by some other things. Furthermore, the actuating levers also project beyond the opposed side edges of the female member, thus being also liable to be caught by some other things. Furthermore, the projecting actuating levers are also liable to be accidentally compressed by some other things, leading to unexpected decoupling of the male member from the female member.

SUMMARY OF THE INVENTION

With the foregoing difficulties in view, it is therefore an object of the invention to provide a buckle wherein a male member and a female member are assuredly coupled with each other, which is easy to manipulate in coupling and decoupling the male and female member and which is exempt from accidental separation due to getting caught by extraneous things.

According to the present invention, there is provided a buckle comprising a male member and a female member adapted to couple with each other. The male member includes a base, a tongue-shaped presser plate extending from the base, a pair of legs provided on the lower side of the presser plate and a pair of locking means one provided on the distal end of each leg. The female member includes a front wall, a pair of side walls provided on the opposed sides of the front wall, a recess formed in the front wall for housing the tongue-shaped presser plate therein, a pair of actuating levers provided on the female member adjacent the respective side walls for resilient movement toward or away from each other, and a pair of locking members adapted for locking engagement with the locking means, when the tongue-shaped presser plate is pressed against the recess. The actuating levers 26, when compressed toward each other are adapted to bring the locking members out of locking engagement with the locking means. The tongue-shaped presser plate and the actuating levers are substantially coplanar with the front wall and the corresponding side walls respectively, when the male and the female member are coupled with each other. The male member may further include a fitting projection provided on the base so as to lie below and extend substantially in parallel with the presser plate and the female member may have a fitting cavity formed at its one end for fitting engagement with the fitting projection of the male member.

The locking members may be integrally formed on the respective actuating levers, and each have a locking head formed at its upper end for locking engagement with the locking means.

Each leg may have a round tip formed at its distal end and a bevel formed on the outer side of the leg adjacent the round tip.

Many other advantages and features of the present invention will become manifest to those versed in the art upon making reference to the detailed description and the accompanying sheets of drawings in which preferred structural embodiments incorporating the principles of the present invention are shown by way of illustrative examples.

DETAILED DESCRIPTION

Figure 1:
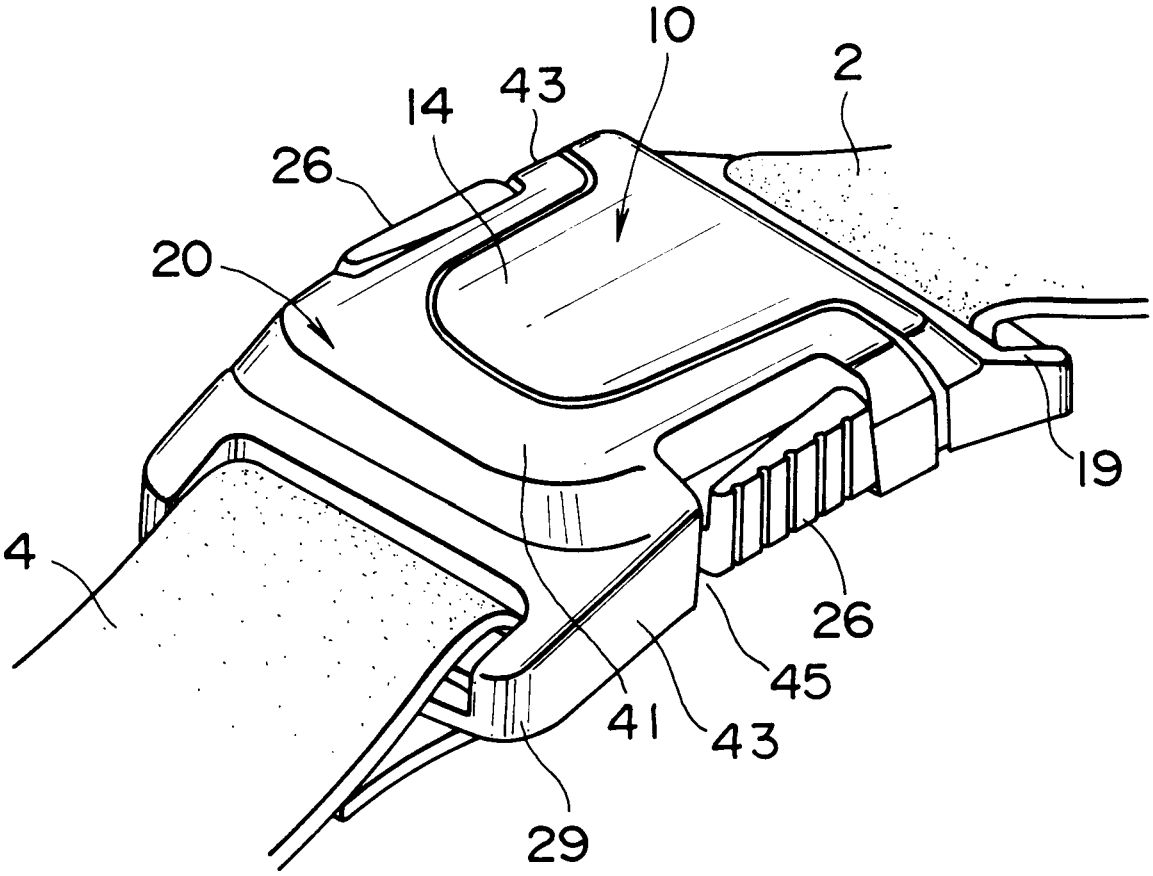
FIG. 1 is a perspective view of a buckle according to the present invention, showing the buckle in coupled disposition, with each side attached to the respective end of a belt.
Figure 2A:
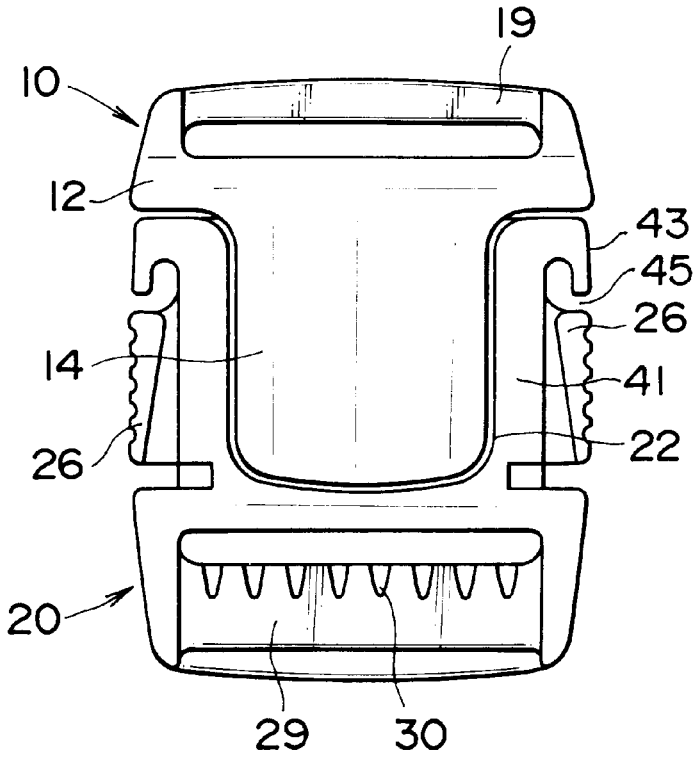
FIG. 2A is a front view of the buckle of FIG. 1 with the belt omitted.
Figure 2B:
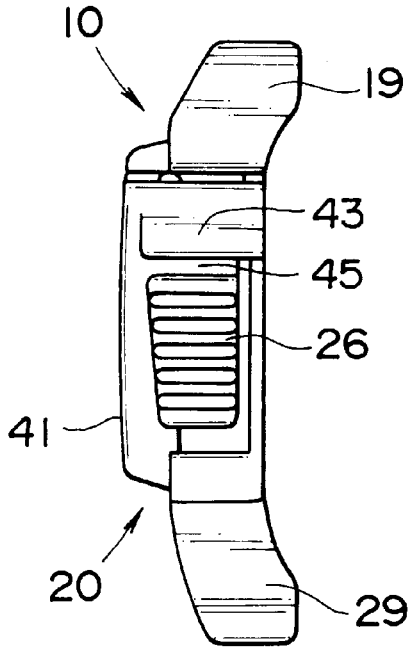
FIG. 2B is a right side view of the buckle of FIG. 2A.

Description is now made of the invention in conjunction with the drawings. FIGS. 1 through 7 show one preferred embodiment of the present invention. A buckle according to this embodiment is used for a wristwatch band. The buckle comprises a male member 10 made of plastic and attached to one end of a band 2, and a female member 20 also made of plastic, attached to one end of the other band 4 and adapted for coupling engagement with the male member 10.

Figure 3A:
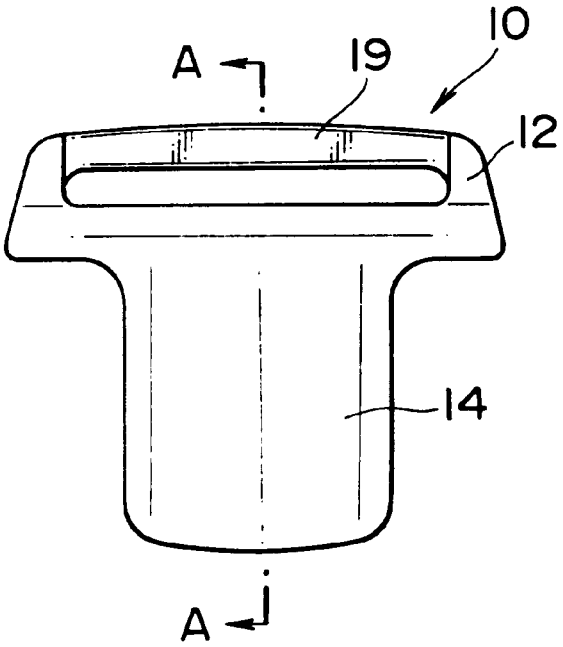
FIG. 3A is a front view of a male member of the buckle of FIG. 2A.
Figure 3B:
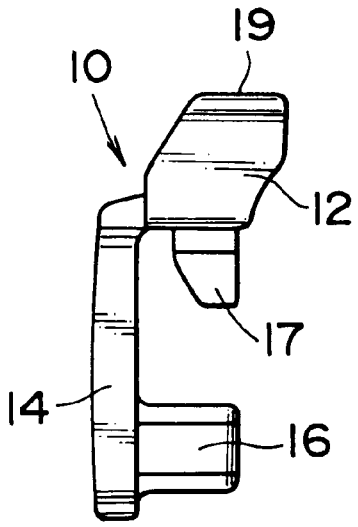
FIG. 3B is a right side view of the male member of FIG. 3A.
Figure 3C:
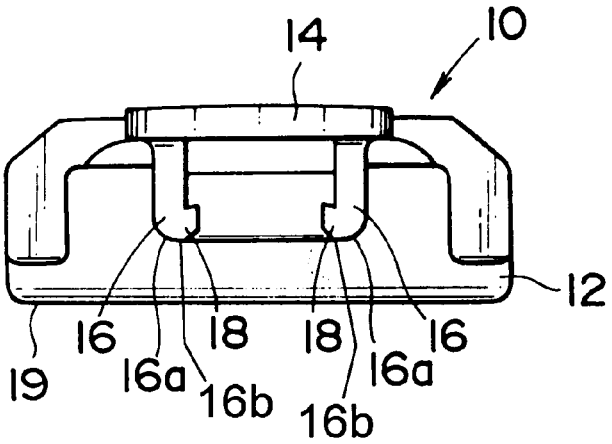
FIG. 3C is a base view of the male member of FIG. 3A.

As better shown in FIGS. 3A through 3C, the male member 10 includes a channel-shaped base 12 and a tongue-shaped presser plate 14 extending from one side of the base 12 at its upper edge. A pair of legs 16, 16 are integrally formed on the lower surface of the presser plate 14 adjacent its distal end. The two legs 16, 16 are separated, laterally of the tongue-shaped presser plate 14, from each other. Each leg 16 hail a hook-shaped locking means 18 formed at its free end. As best-shown in FIG. 3B, the male member 10 further includes a fitting projection 17 provided on the base 12 so as lie below and extend in parallel with the presser plate 14. The channel-shaped base 12 has an attaching crossbar 19 formed on its other side and adapted for joining the end of the band 2. Furthermore, each leg 16 of the male member 10 has a round tip 16*b* formed at its distal end and a bevel 16*a* formed on the outer side of the leg 16 adjacent the round tip 16*b*.

Figure 4A:
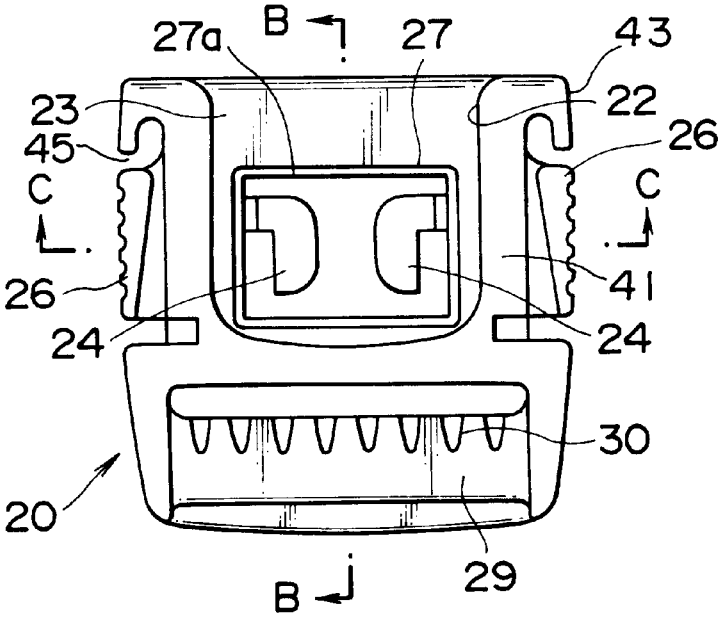
FIG. 4A is a front view of a female member of the buckle of FIG. 2A.
Figure 4B:
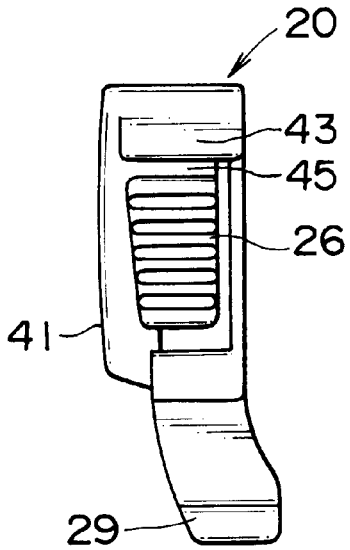
FIG. 4B is a right side view of the female member of FIG. 4A.
Figure 5:
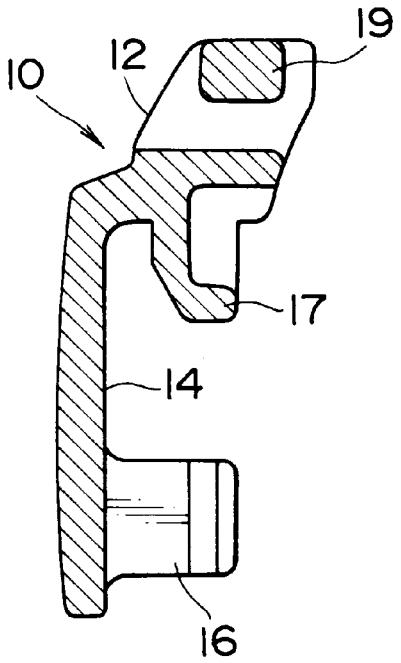
FIG. 5 is a cross-sectional view taken on line A—A of FIG. 3A.
Figure 6:
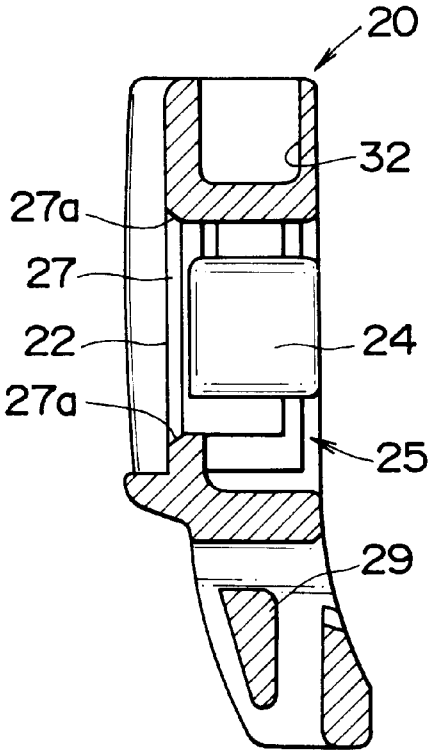
FIG. 6 is a cross-sectional view taken on line B—B of FIG. 4A.
Figure 7:
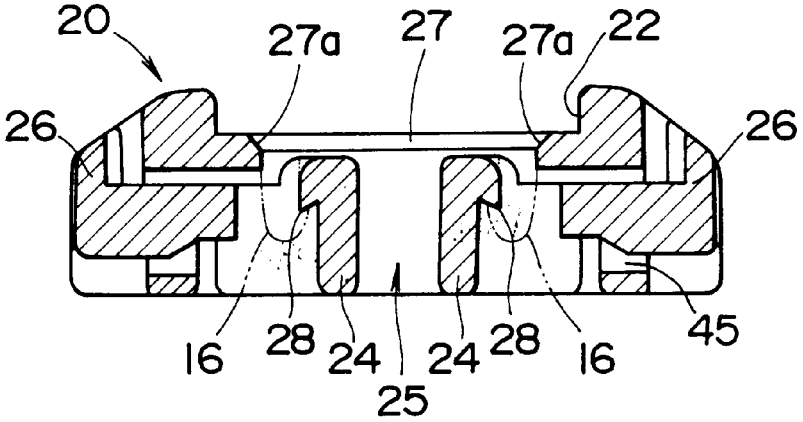
FIG. 7 is a cross-sectional view taken on line C—C of FIG. 4A.

The female member 20 includes a front wall 41, a pair of side walls 43, 43 provided on the opposed sides of the front wall 41. A recess 22 is formed in the front wall 41 and is complementary in shape and size to the tongue-shaped presser plate 14 for receiving the same plate 14 thereon. Formed in the bottom surface 23 of the recess 22 is an inserting rectangular aperture 27 communicating with an inside chamber 25 of the female 20. As shown in FIGS. 4A and 4B, guide edges 27*a* are formed along the edges of the rectangular aperture 27 and are slanted inward downwardly. A pair of side apertures 45, 45 are formed one in each side wall 43 of the female member 20. A pair of resilient actuating lever 26, 26 are integrally formed with and extends lengthwise of the respective side walls 43, 43 of the female member 20 so as to be exposed from the corresponding side apertures 45, 45. The resilient lever 26 terminates in a free end so that the resilient levers 26, 26 are angularly movable about the proximal ends against their own resiliency so as to move themselves or specifically their free ends towards and away from each other. The resilient actuating lever 26 has a locking member 24 integrally formed thereon adjacent the free end so as to extend inwardly therefrom. The locking member 24 has a hook-shaped locking head 28 formed at its upper end and adapted for locking engagement with the locking means 18 of the corresponding leg 16. Importantly, each resilient actuating lever 26 is disposed in coplanar relation with the corresponding side wall 43 of the female member 20. Furthermore, the female member 20 further includes an attaching crossbar 29 provided on its one end and adapted for joining one end of the other band 4. The attaching crossbar 29 has a series of lateral grooves 30 formed on the upper surface along the inner longitudinal edge so as to provide increased friction with the band 4. In the end of the female member 20, opposed to the attaching crossbar 29, a fitting cavity 32 is formed open outward and adapted for receiving the fitting projection 17 of the male member 10.

In order to couple the male member 10 and the female member 20 of the buckle, first, the fitting projection 17 of the male member 10 is brought into fitting engagement with the fitting cavity 32 of the female member 20. Thereafter, the tongue-shaped presser plate 14 of the male member 10 is pressed against the recess 22 of the female member 20 so that the legs 16, 16 provided on the presser plate 14 are forced through the inserting aperture 27 into the chamber 25. The legs 16, 16 are forced deep into the chamber, urging the locking members 28 inward of the chamber 25, until the locking means 18 of the locking legs 16, 16 come into locking engagement with the locking members 28 of the locking member 24. As a result, the male member 10 comes into coupling engagement with the female member 20 with the tong-shaped presser plate 14 fitted or nested into the recess 22 so that the outer surface of the tong-shaped presser plate 14 is disposed coplanar with the outer surface of the front wall 41 of the female member 20.

In order to decouple the male member 10 from the female member 20, the pair of actuating levers 26, 26 are pressed toward each other against its own resiliency, thus causing the locking members 28 to move inwardly of the chamber 25, thereby bringing the locking heads 28 out of locking engagement with the locking means 18. Then, the tongue-shaped presser plate 14 is raised out of fitting engagement with the recess 22, and the fitting projection 27 is brought out of fitting engagement with the fitting cavity 32, 80 that the male member 10 comes out of coupling engagement with the female member 20. When the tongue-shaped presser plate 14 is raised, the beveled surface 16*a* formed on the outer side adjacent its round tip 16*b* prevents the leg 16 from excessively contacting the peripheral edge of the inserting aperture 27, thus decreasing frictional resistance so that the male member 10 and female member 20 can be separated smoothly.

Since the tongue-shaped presser plate 14 comes into nesting engagement with the recess 22 with the presser plate 14 disposed coplanar with the front wall 41, and the actuating levers 26, 26 coplanar with the respective side walls 43, 43, almost nothing projects on the front and opposed sides of the buckle. Therefore, if the buckle is used in the circumstances that there are many extraneous things therearound, as used in wrist watch bands, the buckle is fully exempt from being caught by the extraneous things, so that the male member 10 will never be accidentally decoupled from the female member 20. The fitting engagement of the fitting projection 17 of the male member 10 with the fitting cavity 32 of the female member 20 advantageously helps to retain the male member 10 and the female member 20 in coupling engagement with each other. This fitting engagement also helps to accurately position the male member 10 into coupling engagement with the female member 20. This fitting engagement still further helps to enhance the coupling strength of the male and female members 10, 20. A mere compression of the actuating levers 26, 26 toward each other causes the locking legs 16, 16 come out of the locking heads 28, 28 so that a wearer can readily decouple the male member 10 from the female member 20 with only one hand.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. A buckle comprising a male member and a female member adapted to couple with each other, the male member including a base, a tongue-shaped presser plate extending from the base, a pair of legs provided on the lower side of the presser plate and a pair of locking means one provided on the distal end of each leg; the female member including a front wall, a pair of side walls provided on the opposed sides of the front wall, a recess formed in the front wall for housing the tongue-shaped presser plate therein, a pair of actuating levers provided on the female member adjacent the respective side walls for resilient movement toward or away from each other, and a pair of locking members adapted for locking engagement with the locking means when the tongue-shaped presser plate is pressed against the recess; the actuating levers, when compressed toward each other, being adapted to bring the locking members out of locking engagement with the locking means; an outer surface of the tongue-shaped presser plate and an outer surface of each actuating lever being substantially coplanar with an outer surface of the front wall and an outer surface of the corresponding side wall respectively, when the male and the female members are coupled with each other.

2. A buckle according to claim 1, wherein the male member further includes a fitting projection provided on the base so as to lie below and extend substantially in parallel with the presser plate, the female member having a fitting cavity formed at its one end for fitting engagement with the fitting projection of the male member.

3. A buckle according to claim 1, wherein the locking members are integrally formed on the respective actuating levers, and each have a locking head formed at its upper end for locking engagement with the locking means.

4. A buckle according to claim 1, wherein each leg has a round tip formed at its distal end and a bevel formed on the outer side of the leg adjacent the round tip.

5. A buckle comprising:

a male member having a base, a tongue-shaped presser plate extending from the base, and a pair of locking legs on a lower side of the presser plate; and a female member having a front wall, a pair of side walls on opposite sides of the front wall, a presser plate receiving recess in the front wall, a pair of unlocking actuating levers, each unlocking actuating lever adjacent one of the side walls, the actuating levers being resiliently removable toward and away from each other, and a pair of locking members;

the locking members on the female member and the locking legs on the male member being in locking engagement with each other when the presser plate is pressed into the presser plate receiving recess;

the presser plate having an outer surface which is substantially coplanar with an outer surface of the front wall when the presser plate is pressed into the presser plate receiving recess.

6. A buckle according to claim 5, wherein each unlocking actuating lever has an outer surface which is substantially coplanar with an outer surface of the lever's respective side wall.

* * * * *